US005586760A

United States Patent [19]

Hauter

[11] Patent Number: 5,586,760

[45] **Date of Patent: *Dec. 24, 1996**

[54] SOCCER TRAINING BELT FOR USE WITH A CORD SUSPENDED SOCCER BALL

[76] Inventor: Bradley D. Hauter, 433 Harvest Gate, Lake In The Hills, Ill. 60102

[ * ] Notice: The term of this patent shall not extend beyond the expiration date of Pat. No. 5,443,576.

[21] Appl. No.: 510,357

[22] Filed: Aug. 2, 1995

Related U.S. Application Data

[63] Continuation-in-part of Ser. No. 273,761, Jul. 22, 1994, Pat. No. 5,443,576.

[51] Int. Cl.[6] ..... A63B 67/10

[52] U.S. Cl. ..... 273/58 C; 273/414; 273/DIG. 19; 273/DIG. 20

[58] Field of Search ..... 273/58 C, DIG. 30, 273/DIG. 17–19, 413, 414, 26 R, 1.5 A, 29 A; 434/251

[56] References Cited

U.S. PATENT DOCUMENTS

| | | | |
|---|---|---|---|
| 667,563 | 2/1901 | Oakley | 273/DIG. 19 |
| 3,224,774 | 12/1965 | Klotz . | |
| 3,782,727 | 1/1974 | Chirnomas . | |
| 3,863,924 | 2/1975 | Gagnon . | |
| 4,003,575 | 1/1977 | Hobbs | 273/DIG. 19 |
| 4,021,035 | 5/1977 | O'Hara | 273/DIG. 19 |
| 4,042,241 | 11/1977 | Collins . | |
| 4,059,271 | 11/1977 | Depre . | |
| 4,071,241 | 1/1978 | Cortes Garcia . | |
| 4,121,822 | 10/1978 | DiSabatino . | |
| 4,145,046 | 3/1979 | Jones . | |
| 4,156,574 | 5/1979 | Boden . | |
| 4,400,907 | 8/1983 | Alter et al. . | |
| 4,687,209 | 10/1987 | Carey . | |
| 4,871,178 | 10/1989 | Diaz . | |
| 5,080,376 | 1/1992 | Lerner et al. . | |
| 5,094,462 | 3/1992 | Boyle et al. . | |
| 5,165,696 | 11/1992 | Saha . | |
| 5,199,715 | 4/1993 | May . | |
| 5,244,206 | 9/1993 | Clark et al. . | |
| 5,358,258 | 10/1994 | Killion | 273/29 A |

*Primary Examiner*—Steven B. Wong
*Attorney, Agent, or Firm*—Charles F. Meroni, Jr.

[57] ABSTRACT

A soccer training apparatus is provided. The apparatus has a mesh soccer net sized and configured for encapsulating a soccer ball and loosely holding the soccer ball within the mesh soccer net enabling the encapsulated soccer ball to freely rotate within. A waist belt has first and second belt ends adjustably connectable to one another for securement around a waist of a user. A cord has a first portion attached to the mesh soccer net and a second portion operatively connected to the waist belt leaving the mesh soccer net carrying the soccer ball suspended from the waist belt.

12 Claims, 5 Drawing Sheets

Fig. 10
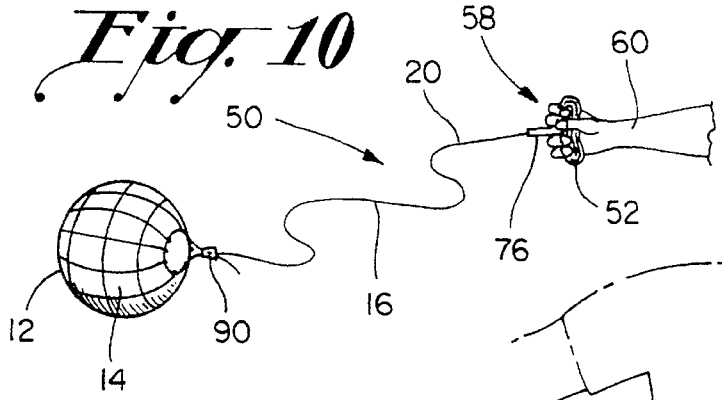
Fig. 11
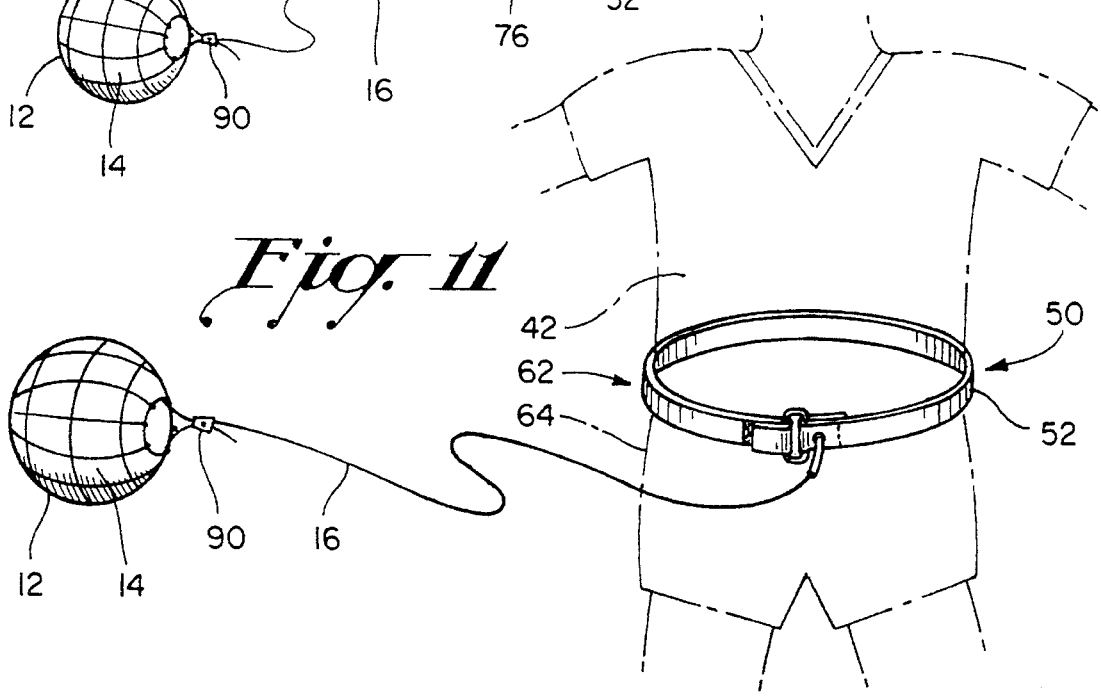
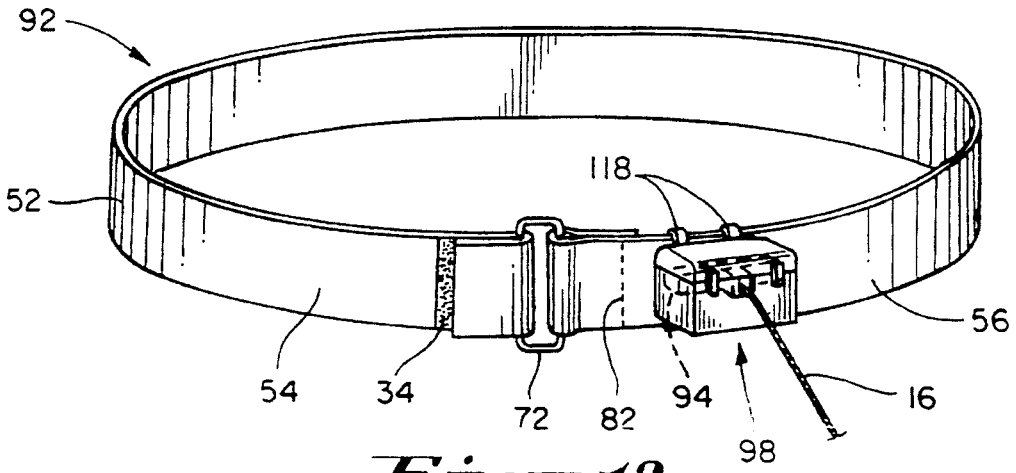
Fig. 12

SOCCER TRAINING BELT FOR USE WITH A CORD SUSPENDED SOCCER BALL

This is a continuation-in-part of Ser. No. 08/273,761, filed Jul. 12, 1994, now U.S. Pat. No. 5,443,576.

TECHNICAL FIELD

The present invention relates generally to a soccer training device, and more particularly, to a soccer training belt for use with a cord suspended soccer ball.

BACKGROUND ART

Many different types of soccer training devices are known in the art. An important object of these devices is to provide a way for an individual to practice his or her soccer technique alone.

U.S. Pat. No. 5,094,462 issued to Boyle et al., discloses a soccer training device having a net which holds a soccer ball. An elastic cord is connected to the net on one end and is connected to a wrist or ankle strap on the other end. This invention, however, suffers from a number of disadvantages. The use of an elastic cord allows a returning soccer ball to gain in speed making it difficult for younger players to develop their technique. The use of a wrist or ankle strap will provide for an untrue return of the soccer ball due to an increased human variability in the changing positioning of a player's arms or legs. In addition, the length of elastic cord is not adjustable for allowing a player to have varied positioning and distance with the soccer ball.

U.S. Pat. No. 4,042,241 issued to Collins, discloses a soccer training device having elastic cord which is attached at one end to a soccer ball and at its other end to a flexible loop which fits around the foot, head or neck. Like the device by Boyle el al., the use of elastic cord creates a disadvantage for younger players. In addition, the Collins device attaches the elastic cord directly to the soccer ball. This form of attachment suffers from a number of disadvantages. The point of attachment creates a knob like structure on the ball which will prevent the ball from flying straight and returning straight. The natural rotational forces of a kicked ball will be hindered because the ball is directly connected to the cord. If a player where to kick the ball at the point of attachment, the knob like structure would prevent the player from obtaining a natural kick. In a worst case, the player could injure his or her foot.

U.S. Pat. No. 5,080,376 issued to Lerner et al. and U.S. Pat. No. 4,687,209 issued to Carey, disclose soccer training devices. Both devices suffer from some the same disadvantages previously stated in that the devices have a tether which is secured directly to the ball and do not allow for adjustability in the length of the tether. For example, Lerner attaches a tether cord to the ball with a stud having an enlarged head, which prevents natural rotation of the ball and creates a safety hazard if the foot of a player comes in direct contact with the stud.

A more desirable soccer training device is one which would allow tier a more true or natural kick of the ball, would be applicable for players of all ages and skill levels, and would provide a more consistent return location of the ball.

DISCLOSURE OF THE INVENTION

Accordingly, it is an object of this invention to provide a soccer training apparatus which does not restrict the arms or legs of a player during ball dribbling or juggling.

Another object of the present invention is to provide a soccer training apparatus which will provide a truer and more natural kick and flight of a ball.

Another object of the present invention is to provide a soccer training apparatus that can be selectively worn around the waist or a player or held in the hand of a player.

Still another object of the present invention is to provide a soccer training apparatus which will allow a player to adjust the length of an attached cord.

Yet another object of the present invention is to provide a soccer training apparatus which is usable by players of all sizes and shapes.

To achieve the foregoing and other objectives, and in accordance with the purposes of the present invention a soccer training apparatus is provided. The apparatus has a mesh soccer net sized and configured for encapsulating a soccer ball and loosely holding the soccer ball within the mesh soccer net enabling the encapsulated soccer ball to freely rotate within. A waist belt has first and second belt ends adjustably connectable to one another for securement around a waist of a user. A cord has a first portion attached to the mesh soccer net and a second portion operatively connected to the waist belt leaving the mesh soccer net carrying the soccer ball suspended from the waist belt.

In accordance with an aspect of the invention, the waist belt is formed of a coilable material enabling the waist belt to be configured into a coiled position for holding in a hand of a user and into an uncoiled position for securement around a waist of the user.

In accordance with another aspect of the invention, a hand grip is provided and connected to the second portion of the cord and wherein the second portion of the cord is operatively connected to the waist belt by means for detachably securing the hand grip to the waist belt.

Other objects, features and advantages of my invention will become more readily apparent upon reference to the following description when taken in conjunction with the accompanying drawings.

BRIEF DESCRIPTION OF THE DRAWINGS

In the drawings:

FIG. 10 is a perspective view of the second embodiment for use in the hand of user with the belt in a coil position;

FIG. 11 is a perspective view of the second embodiment with the belt in an uncoiled position for use adjustable securement around the waist of a user;

FIG. 12 is a perspective view of a third embodiment of the apparatus of the present invention;

BEST MODE FOR CARRYING OUT THE INVENTION

Figure 1:
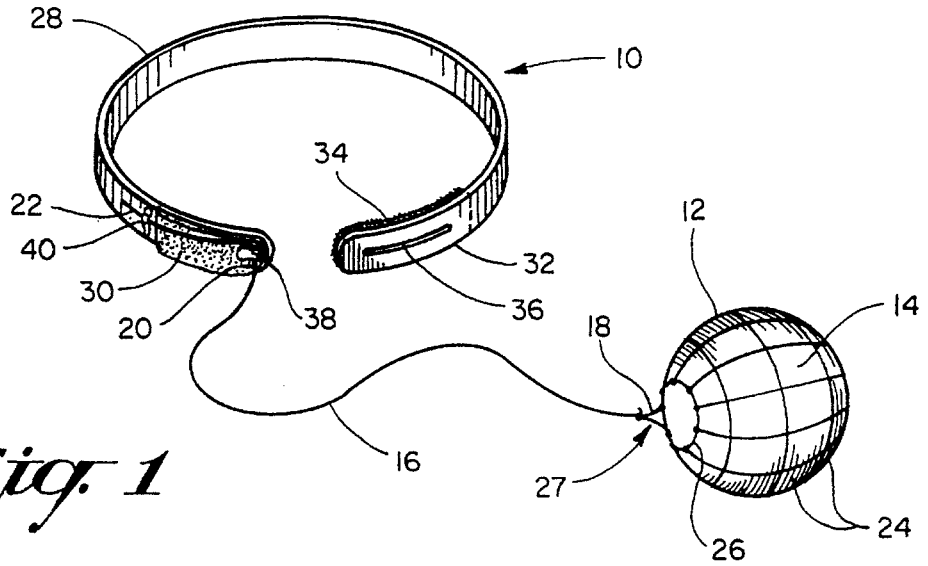
FIG. 1 is a perspective view of a first embodiment of the apparatus of the present invention.

Referring now to the drawings, FIGS. 1–6 illustrate a first embodiment of a soccer training apparatus 10. The apparatus 10 has a mesh soccer net 12 sized for encapsulating a soccer ball 14. Preferably, the mesh soccer net 12 is made from a strong lightweight material, such as nylon.

Figure 2:
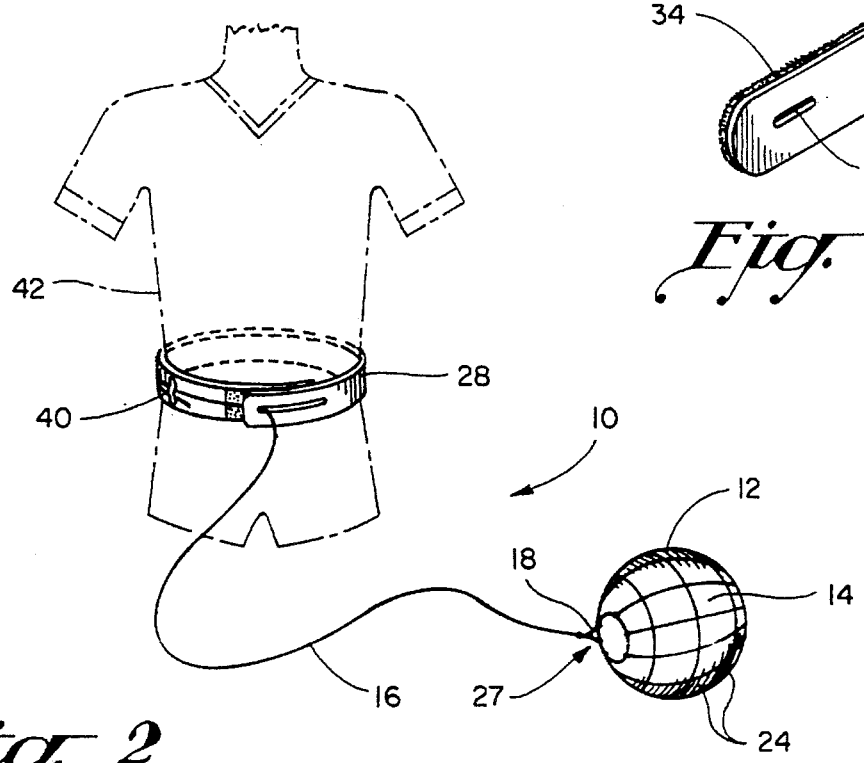
FIG. 2 is a perspective view of the apparatus of FIG. 1 being worn by a player.
Figure 4:
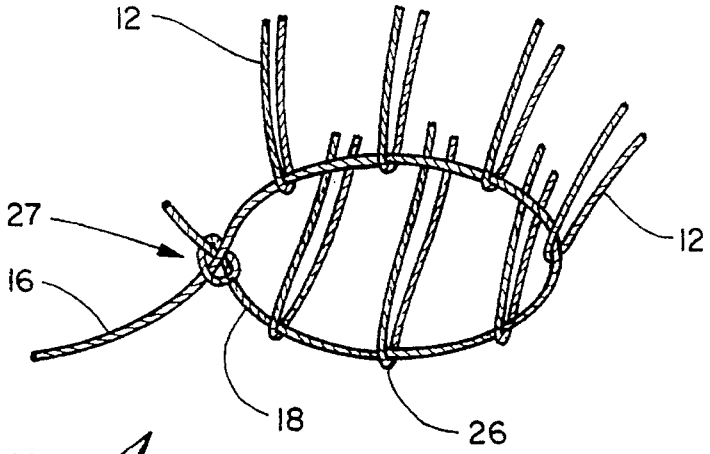
FIG. 4 is a fragmentary perspective view of the cord connected to the mesh soccer net.

A non-elastic tether or cord 16 has a first end or portion 18, a securing or second portion 20, and a second end 22. The first end 18 of the cord 16 is attached to the mesh soccer net 12. Preferably, the cord 16 is physically attached at the first end 18 to the mesh soccer net 12 in a drawstring type fashion by gathering the mesh soccer net 12. This may be achieved in number of different configurations where the cord 16 is looped or threaded through a number of soccer net holes 24 around the edges of a net opening 26 of the mesh soccer net 12, as best illustrated in FIG. 4. As shown in FIGS. 1 and 2, the net opening 26 of the mesh soccer net 12 is then gathered or cinched closed, so that the mesh soccer net 12 encapsulates the soccer ball 14. The cord 16 is made from a strong lightweight material, such as nylon.

Preferably, the first end 18 of the cord 16 is slidably connected to the cord 16 for opening and closing of the mesh soccer net 12 in the drawstring type fashion described above. This may be achieved with the use of a slide type knot 27, a small ring or circle mounted on the very tip of the first end 18 of the cord 16, which would encircle the cord 16 in a slidable manner, or any other type of commonly known method used to secure the end of a drawstring.

Referring to FIG. 1, a waist belt 28 has an inner lapped belt end 30 and an outer lapped belt end 32. Hook and loop type fasteners or fastening means 34, such as VELCRO, are provided on confronting faces of the inner lapped belt end 30 and outer lapped belt end 32 for securing the inner lapped belt end 30 and outer lapped belt end 32 in detachable assembly together. The waist belt 28 itself may be formed of a double sided hook and loop fastening material, where one sided is mated for engagement of the other side. Alternatively, the waist belt is formed from a material, such as cotton or nylon, with the hook and loop fastening means 34 connected to the outer surfaces of the waist belt. The waist belt may also be formed from an elastic material.

Figure 3:
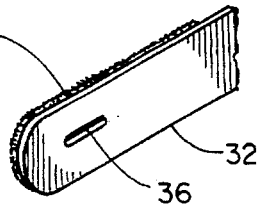
FIG. 3 is a fragmentary side view of an alternative embodiment of the outer lapped belt end of the first embodiment.

The outer lapped belt end 32 has a slot 36 of sufficient size for insertion of the cord 16 through it, as shown in FIG. 3. In a preferred manner of this embodiment, the slot 36 is elongated and of sufficient size to permit a soccer ball or net of any variety to be inserted through, as shown in FIG. 1.

Figure 5:
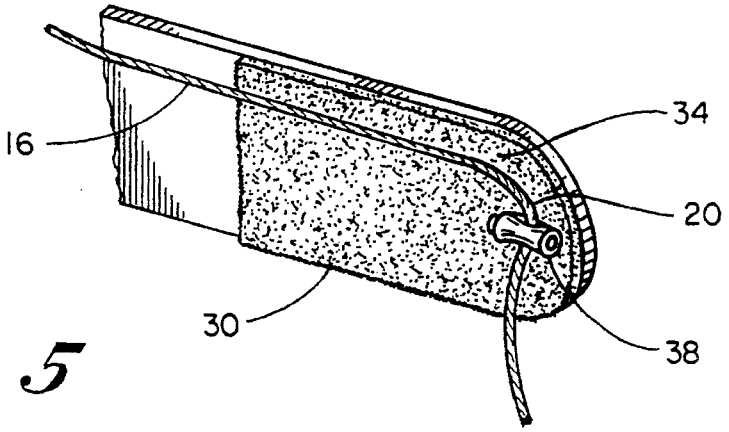
FIG. 5 is a fragmentary side view of the inner lapped belt end of the first embodiment.
Figure 6:
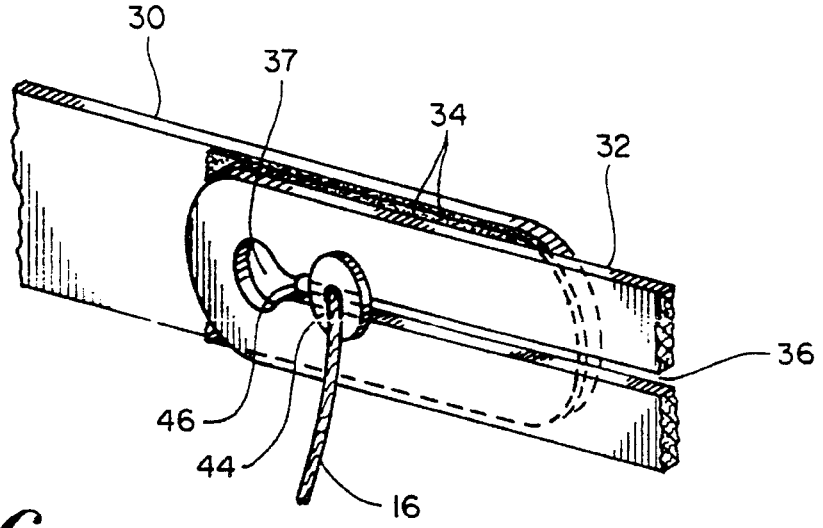
FIG. 6 is a fragmentary side view of an alternative embodiment for the inner and outer lapped belt ends of the first embodiment.

As best illustrated in FIG. 5, the inner lapped belt end 30 contains a length adjusting lock 38 for securing the securing portion 20 of the cord 16 to the inner lapped belt end 30. This length adjusting lock 38 can be of any sort of adjusting clamp, clasp, cord locking device, or spring loaded cord lock, all of which are known to one skilled in the art.

It is to be understood that in an alternative embodiment, the cord 16 could be permanently secured to the inner lapped belt end 30. In another embodiment shown in FIG. 6, a spring loaded retractable reel 44 having a reel lock 46 is provided instead of the length adjusting lock 38. The reel 44 is connected to the inner lapped belt end 30 at a bottom reel portion which is of a diameter less than the reel 44. The reel 44 is readily available commercially and is commonly used for dog leashes, tape measures, and extension cords. When lap engaging the outer lapped belt end 32 to the inner lapped belt end 30, the slot 36 may have a larger slot end 37 for easily inserting the reel 44 through the outer lapped belt end 32. Alternatively, a cord adjustment 90 as later described could be attached to the first portion of the cord 16.

A strap 40 is provided on the waist belt 28 for securing the second end 22 of the cord 16 to the waist belt 28 at a point on the waist belt 28 remote from where the inner lapped belt end 30 and outer lapped belt end 32 are engaged. This allows for a distance between the mesh soccer net 12 and the adjusting lock 38 to be varied. Preferably, the strap 40 has a hook and loop fastening means on one side thereof for attachment to the hook and loop fastening means on the inner lapped belt end 30. It is to be understood that other types of straps, hooks, or tying or securing means could equally be used in securing the second end 22 of the cord 16 to the waist belt 28.

In use, the apparatus 10 is placed around the waist of a player or user 42, as shown in FIG. 2. The soccer ball 14 which can be previously secured in the mesh soccer net 12 is then placed through the elongated slot 36 of the outer lapped belt end 32, along with the attached cord 16. It should be understood that the net 12 could also be placed through the slot 36 before the ball 14 is inserted within. Next, the outer lapped belt end 32 is adjustably secured to the inner lapped belt end 30. The adjusting lock 38 is exposed through elongated slot 36. When forces are exerted on the cord 16 during practice, the inner lapped belt end 30 will be pressed against the outer lapped belt end 32, which will continually keep the confronting faces of the hook and loop fastening means secured.

Referring now to FIGS. 7–11, a second embodiment of the soccer training apparatus is indicated generally by the numeral 50. A mesh soccer net 12 is provided. The net 12 is sized and configured for encapsulating the soccer ball 14 and loosely holding the soccer ball 14 within the mesh soccer net 12 enabling the encapsulated soccer ball 14 to freely rotate within, as previously shown.

Figure 9:
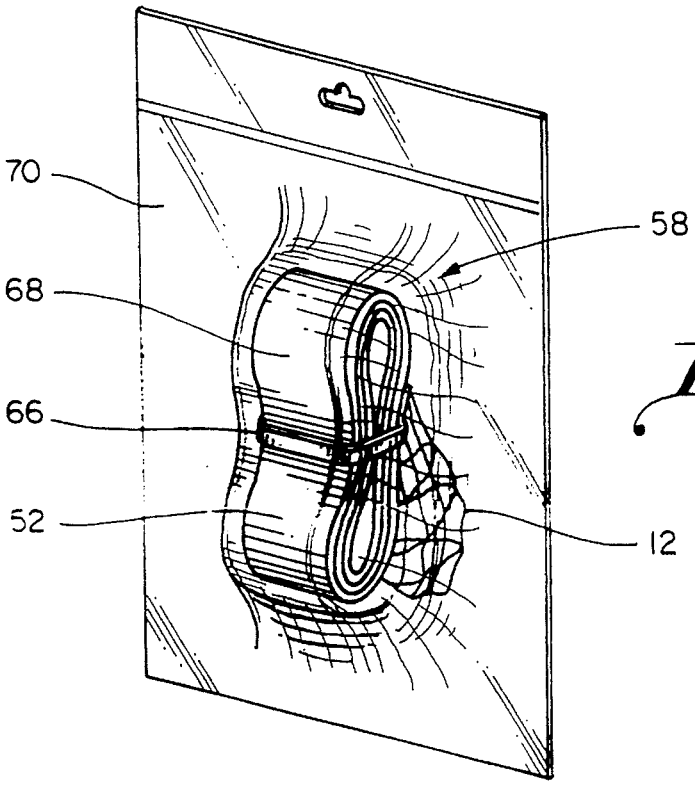
FIG. 9 is a perspective view of the second embodiment in packaged state with the belt in a coiled position.

A waist belt 52 has a first belt end 54 and a second belt end 56. The waist belt 52 is formed of a flexible or coilable material, such as nylon, so that the waist belt 52 is coilable into a coiled position 58 for holding in a hand 60 of a user 42, as illustrated in FIG. 10. A dual purpose clip or strap means 66 of conventional use is removably secured around a center portion 68 of the coiled waist belt 52 so that the waist belt 52 is retained in the coiled position 58 for packaging in a package 70, as shown in FIG. 9. The same strap means 66 used in packaging can then be used to hold the waist belt 52 in the coiled position 58 when held in the hand 60 of the user 42 during foot dribbling and juggling, as shown in FIG. 10, which allows for reduced manufacturing costs and simplified construction.

The waist belt 52 is uncoilable for configuration into an uncoiled position 62 for securement around a waist 64 of the user 42, as illustrated in FIG. 11. Hence, the coiled position 58 and uncoiled position 62 allow for two separate manners of operation of the apparatus.

Figure 7:
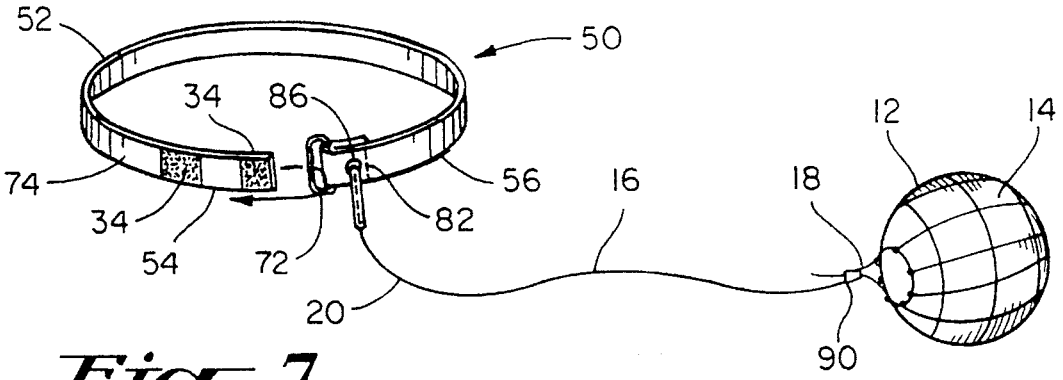
FIG. 7 is a perspective view of a second embodiment of the apparatus of the present invention.
Figure 8:
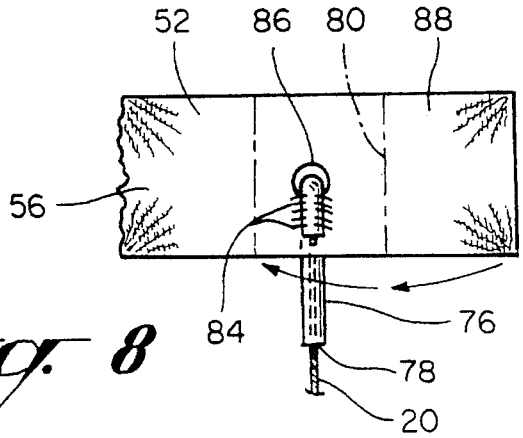
FIG. 8 is a fragmentary side view of the first belt end of the second embodiment.

A belt ring 72 formed of plastic or metal is connected to the second belt end 56. In construction, an outer end 88 of the second belt end 56 is folded along fold line 80 and then stitched along stitch line 82, as illustrated in FIGS. 7 and 8. The first belt end 54 has hook and loop fastening means 34 provided on an outer surface 24 of the first belt end 54 for adjustable and detachable assembly together when the first belt end 54 is inserted and looped through the belt ring 72. Preferably, the fastening means 34 are mated VELCRO sections stitched to the outer surface 24 of the waist belt 52.

The cord 16 has a first portion 18 attached to the mesh soccer net 12. An elongated plastic tube 76 has an aperture 78 extending therethough. The second portion 20 of the cord 16 being extended through the aperture 78. The first belt end has a hole 86 for insertion of the tube 76 and cord 16, with the tube 76 and cord 16 being secured to the waist belt by stitches 84 or other suitable means enabling the tube 76 to provide a protective covering for the second portion 20 of the cord 16. With the second portion 20 of the cord 16 operatively connected to the waist belt 52, the mesh soccer net 12 is left carrying the soccer ball 14 suspended from the waist belt 52. A cord adjustment 90 of conventional design is connected to the cord 16 allowing for manual adjustment of the length of the cord 16 between the mesh soccer net 12 and waist belt 52. Referring to FIG. 7, the cord adjustment 90 creates a secured looped cord portion that is inserted through the net. As shown, the cord adjustment 90 provides a dual function of both adjusting the length of cord and creating a looped configuration of first portion 18 that can engages the net 12.

Referring now to FIGS. 12–17, a third embodiment of the soccer training apparatus is indicated generally by the numeral 92. The net 12 is sized and configured for encapsulating the soccer ball 14 and loosely holding the soccer ball 14 within the mesh soccer net 12 enabling the encapsulated soccer ball 14 to freely rotate within, as in the previous embodiments.

The waist belt 52, net 12 and cord 16 are similar to that previously described and shown in the second embodiment. However, this embodiment differs with respect to the manner of attachment of the cord to the waist belt.

Figure 16:
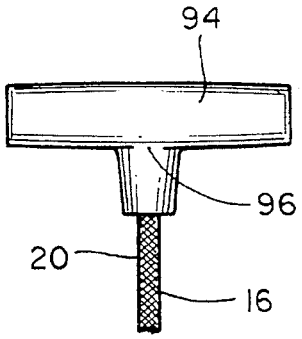
FIG. 16 is a perspective view of a hand grip for use with the third embodiment.
Figure 17:
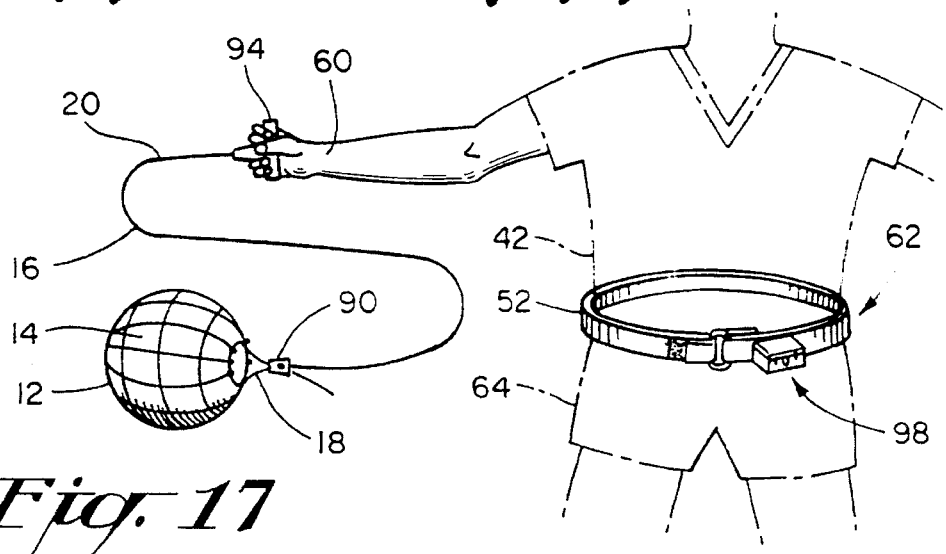
FIG. 17 is a perspective view of the embodiment of the present invention.

In FIG. 16, a rubber or plastic hand grip 94 is shown. The hand grip 94 is T-shaped to allow the hand 60 of a user 42 to firmly grasp the hand grip 94, as shown in FIG. 17. It should be understood that other shapes of the hand grip 94 could also be employed. The second portion 20 of the cord 16 is connected to the hand grip 94 at a center portion 96 of the hand grip 94.

Figure 14:
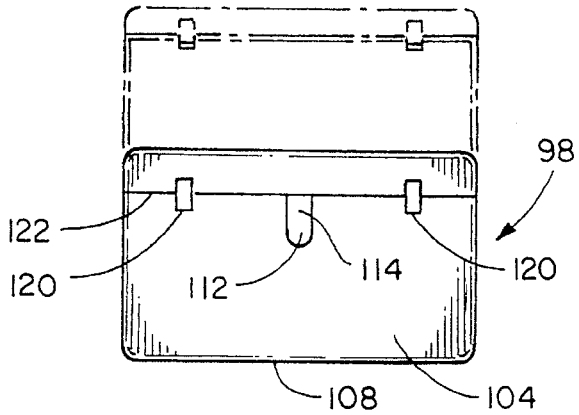
FIG. 14 is a front view of the belt box for use with the third embodiment.
Figure 13:
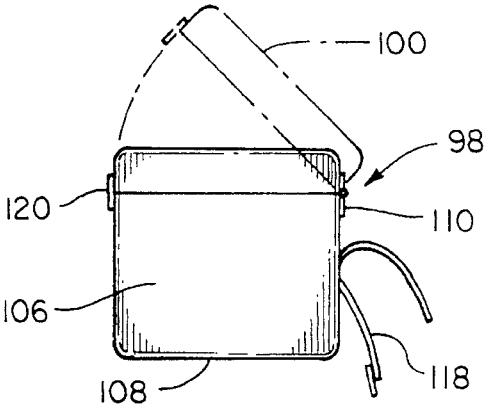
FIG. 13 is a side view of a belt box for use with the third embodiment.
Figure 15:
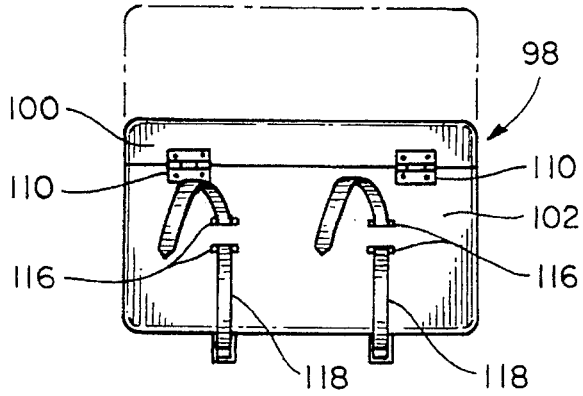
FIG. 15 is a rear view of the belt box for use with the third embodiment.

To allow a user 42 to selectively practice with cord 16, net 12 and ball 14 suspended from the hand 60 or the waist 64, the hand grip 94 is detachably secured to the waist belt 92. Referring to FIGS. 13–15, a retaining box 98 has a top side 100, a rear side 102, a front side 104, end sides 106, and a bottom side 108. The box 98 being preferably formed of plastic and sized to encapsulate the hand grip 94. The top side 100 being pivotally secured to the rear side 102 by hinges or crimped edges 110. The front side 104 has a cord indention 112, as shown in FIG. 14. The sides of the box 98 define a cavity 114 therewithin in communication with the cord indention 112 so that the hand grip 94 can be selectively secured within the cavity 114 of the retaining box with the cord 16 extending through the cord indention 112, as shown in FIG. 12, leaving the mesh soccer net 12 carrying the soccer ball 14 suspended from the waist belt 92.

Referring to FIG. 12 and 15, the rear side 102 is connected to the waist belt 92. The rear side has securing holes 116 for attaching the box 98 to the waist belt 92 by suitable means, such as by stitching through the holes or with a pair of box straps 118 of suitable type.

The top side 100 of the box 98 has extending tabs 120 formed integral with the top side for releasably securing with an upper edge 122 of the front side 104 when the top side 100 is pivoted into a closed or secured position to enable the hand grip 94 to be secured within the cavity 114 of the box 98.

It should be understood that other combinations of features of the above-described embodiments are possible. Although the invention has been described by reference to some embodiments it is not intended that the novel device be limited thereby, but that modifications thereof are intended to be included as falling within the broad scope and spirit of the foregoing disclosure, the following claims and the appended drawings.

I claim:

1. A soccer training apparatus, comprising:

(a) a mesh soccer net sized and configured for encapsulating a soccer ball and loosely holding the soccer ball within the mesh soccer net enabling the encapsulated soccer ball to freely rotate within;

(b) a waist belt having first and second belt ends adjustably connectable to one another for securement around a waist of a user;

(c) a cord formed of a non-elastic material, the cord having a first portion attached to the mesh soccer net in a drawstring type fashion by gathering the mesh soccer net, the cord having a second portion operatively connected to the waist belt leaving the mesh soccer net carrying the soccer ball suspended from the waist belt; and (d) cord adjustment means connected to the cord for manually adjusting the length of the cord between the mesh soccer net and waist belt.

2. The apparatus of claim 1, further comprising hook and loop fastening means provided on confronting faces of the first and second belt ends for securing the first and second belt ends in lapped detachable assembly together, the second belt end having a slot of sufficient size to permit insertion of the cord through the slot.

3. The apparatus of claim 1, further comprising a belt ring connected to the second belt end, the first belt end having hook and loop fastening means provided on an outer surface of the first belt end for detachable assembly together when the first belt end is looped through the belt ring.

4. The apparatus of claim 3, further comprising an elongated plastic tube having an aperture extending therethough, the second portion of the cord being extended through the aperture with the tube and cord being secured to the waist belt enabling the tube to provide a protective covering for the second portion of the cord.

5. The apparatus of claim 1, wherein the waist belt is formed of a coilable material enabling the waist belt to be configured into a coiled position for holding in a hand of a user and into an uncoiled position for securement around a waist of the user.

6. The apparatus of claim 5, further comprising retaining means for securing the waist belt in the coiled position.

7. A soccer training apparatus, comprising:

(a) a mesh soccer net sized and configured for encapsulating a soccer ball and loosely holding the soccer ball within the mesh soccer net enabling the encapsulated soccer ball to freely rotate within;

(b) a waist belt having first and second belt ends adjustably connectable to one another, the waist belt being formed of a coilable material so that the waist belt is coilable into a coiled position for holding in a hand of a user and uncoilable into an uncoiled position for securement around a waist of the user;

(c) a cord formed of a non-elastic material, the cord having a first portion attached to the mesh soccer net in a drawstring type fashion by gathering the mesh soccer net, the cord having a second portion operatively connected to the waist belt leaving the mesh soccer net carrying the soccer ball suspended from the waist belt; and (d) cord adjustment means connected to the cord for manually adjusting the length of the cord between the mesh soccer net and waist belt and securing the first portion of the cord in a looped configuration for attachment with the net.

8. The apparatus of claim 7, further comprising retaining means for securing the waist belt in the coiled position.

9. The apparatus of claim 8, wherein the retaining means includes a dual purpose clip removably secured around a center portion of the coiled waist belt so that the waist belt is retained in the coiled position for packaging and when selectively held in the hand of a user for foot dribbling and juggling.

10. The apparatus of claim 9, further comprising a belt ring connected to the second belt end, the first belt end having hook and loop fastening means provided on an outer surface of the first belt end for detachable assembly together when the first belt end is looped through the belt ring.

11. The apparatus of claim 7, further comprising an elongated plastic tube having an aperture extending therethough, the second portion of the cord being extended through the aperture with the tube and cord being secured to the waist belt enabling the tube to provide a protective covering for the second portion of the cord.

12. A soccer training apparatus, comprising:

(a) a mesh soccer net sized and configured for encapsulating a soccer ball and loosely holding the soccer ball within the mesh soccer net enabling the encapsulated soccer ball to freely rotate within;

(b) a waist belt having first and second belt ends detachably connectable to one another for securement around a waist of a user;

(c) a cord formed of a non-elastic material, the cord having a first portion attached to the mesh soccer net in a drawstring type fashion by gathering the mesh soccer net, the cord having a second portion operatively connected to the waist belt leaving the mesh soccer net carrying the soccer ball suspended from the waist belt; and (d) cord adjustment means connected to the cord for manually adjusting the length of the cord between the mesh soccer net and waist belt and securing the first portion of the cord in a looped configuration for attachment with the net.

* * * * *